US006978819B2

(12) United States Patent
Tanaka et al.

(10) Patent No.: US 6,978,819 B2
(45) Date of Patent: Dec. 27, 2005

(54) TUBULAR LABEL FITTING APPARATUS FOR CONTAINERS

(75) Inventors: Toshihiko Tanaka, Kanagawa (JP); Kazuo Kobayashi, Kanagawa (JP); Kanji Hatano, Kanagawa (JP)

(73) Assignee: Nippon Automatic Fine Machinery Co., Ltd., Kanagawa (JP)

( * ) Notice: Subject to any disclaimer, the term of this patent is extended or adjusted under 35 U.S.C. 154(b) by 46 days.

(21) Appl. No.: 10/620,368

(22) Filed: Jul. 17, 2003

(65) Prior Publication Data

US 2004/0261949 A1 Dec. 30, 2004

(30) Foreign Application Priority Data

Jun. 10, 2003 (JP) ..... 2003-164868

(51) Int. Cl.[7] ..... B65C 3/06; B65C 3/14

(52) U.S. Cl. ..... 156/566; 156/556; 156/567; 156/568; 53/556; 53/557

(58) Field of Search ..... 156/443–447, 156/494, 497, 556, 566–568; 53/556, 557

(56) References Cited

U.S. PATENT DOCUMENTS 4,104,845 A * 8/1978 Hoffmann ..... 53/410
5,417,794 A * 5/1995 Menayan ..... 156/362
5,715,651 A * 2/1998 Thebault ..... 53/399
6,474,390 B1 * 11/2002 Vandevoorde ..... 156/494
6,708,470 B2 * 3/2004 Eiban et al. ..... 53/585
6,755,012 B2 * 6/2004 Frankefort ..... 53/557

FOREIGN PATENT DOCUMENTS

| | | |
|---|---|---|
| JP | 2000-264319 | 9/2000 |
| JP | 200-289715 | 10/2000 |
| JP | 2002-87417 | 3/2002 |

* cited by examiner

*Primary Examiner*—Sue A. Purvis
(74) *Attorney, Agent, or Firm*—Westerman, Hattori, Daniels & Adrian, LLP

(57) ABSTRACT

A label fitting apparatus for fitting a label on a container. The label fitting apparatus includes label fitting heads at even intervals on an outer perimeter of a main turret. Each fitting head includes a container table to support a container, a container presser bar to apply a force to a top of the container, and a label holder to hold the label. Rotation of the main turret causes the container presser bar to lower and pass through a label held by the vacuum jaws to apply a pressing force against a container supported by the container table such that the container is sandwiched between the container table and the container presser bar. The container is transferred in an axial direction relative to the label holder such that the label is fitted on the container.

7 Claims, 11 Drawing Sheets

Fig. 4-A
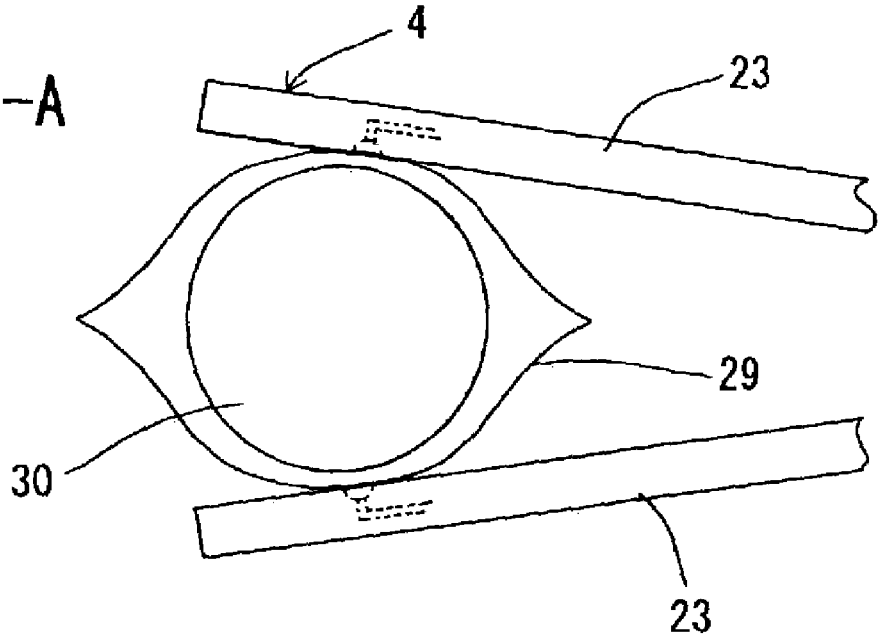
Fig. 4-B
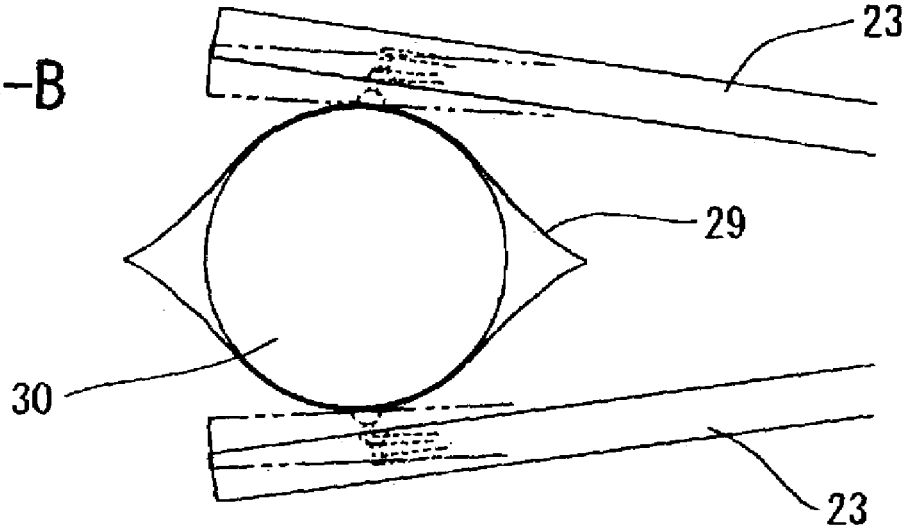

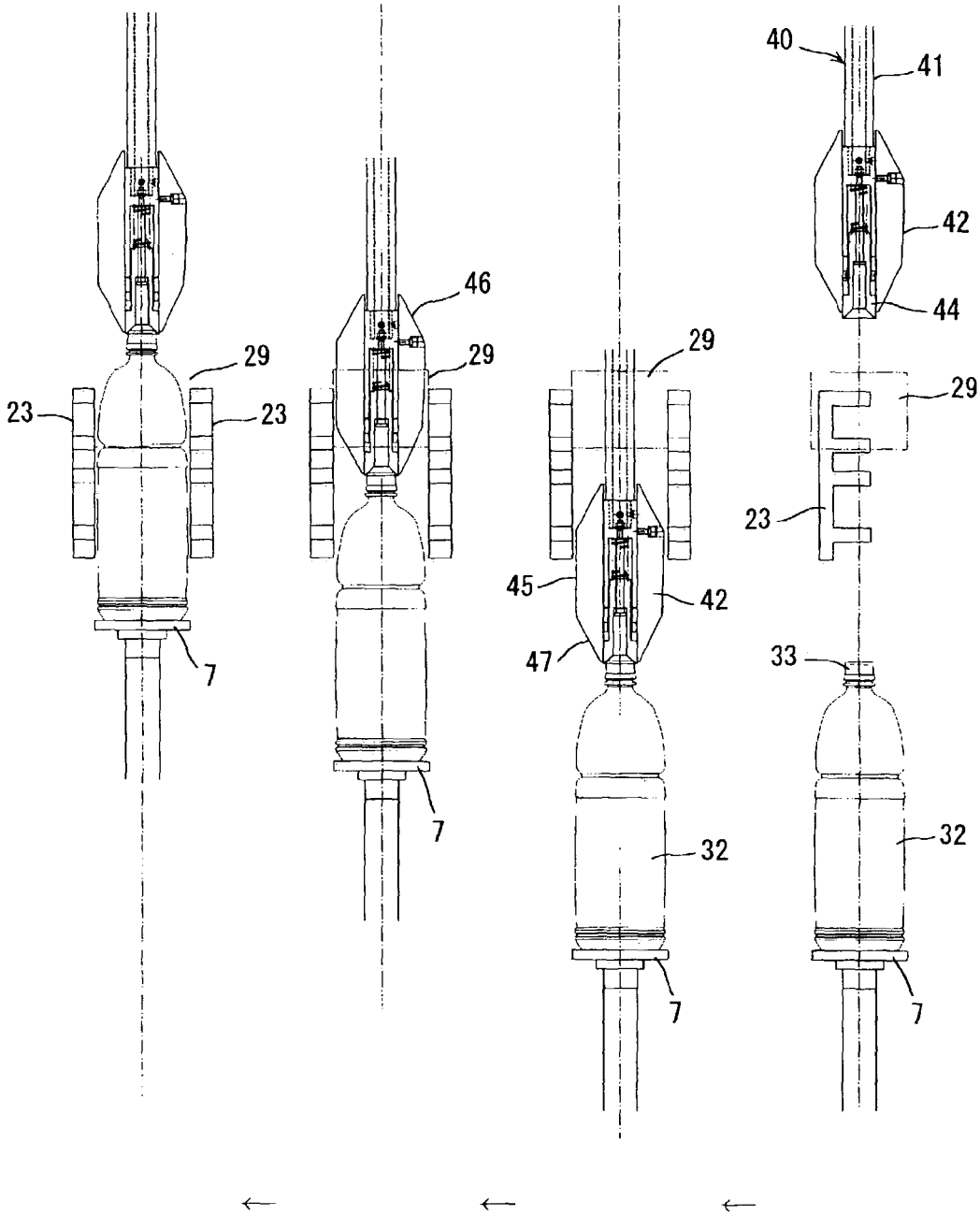
Fig. 6-D Fig. 6-C Fig. 6-B Fig. 6-A

Fig. 7-A
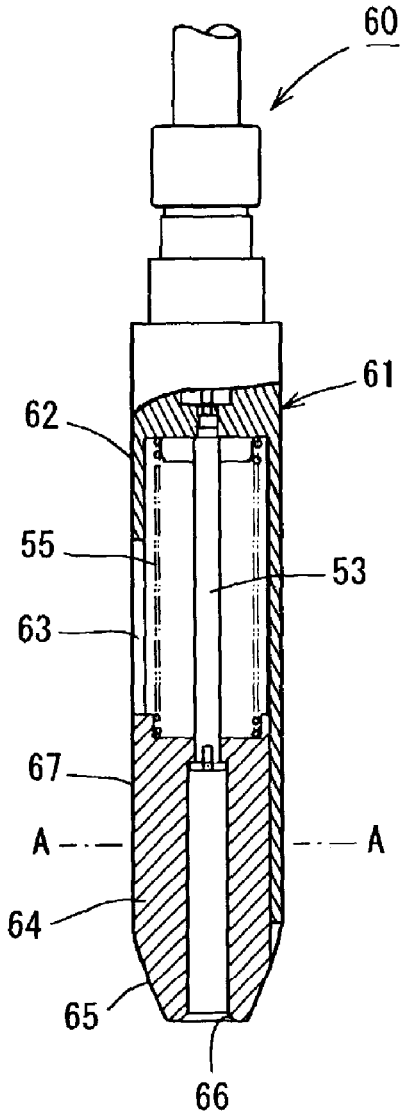
Fig. 7-B
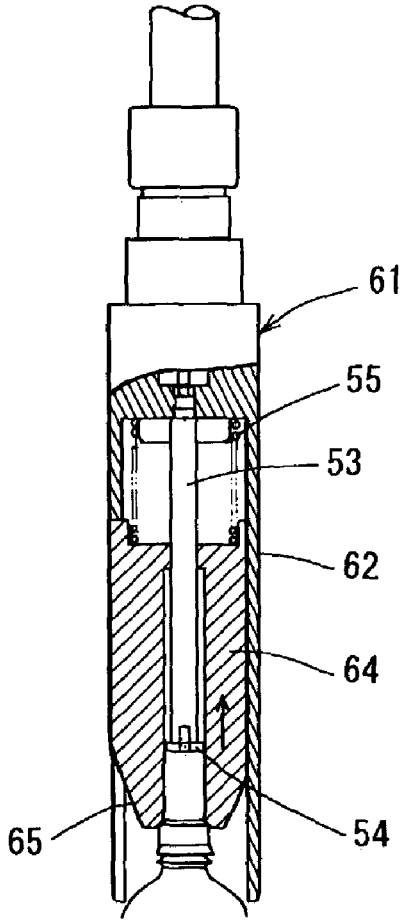
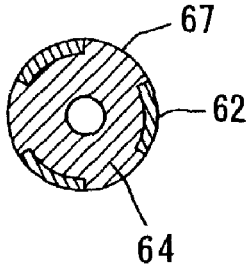
Fig. 7-C

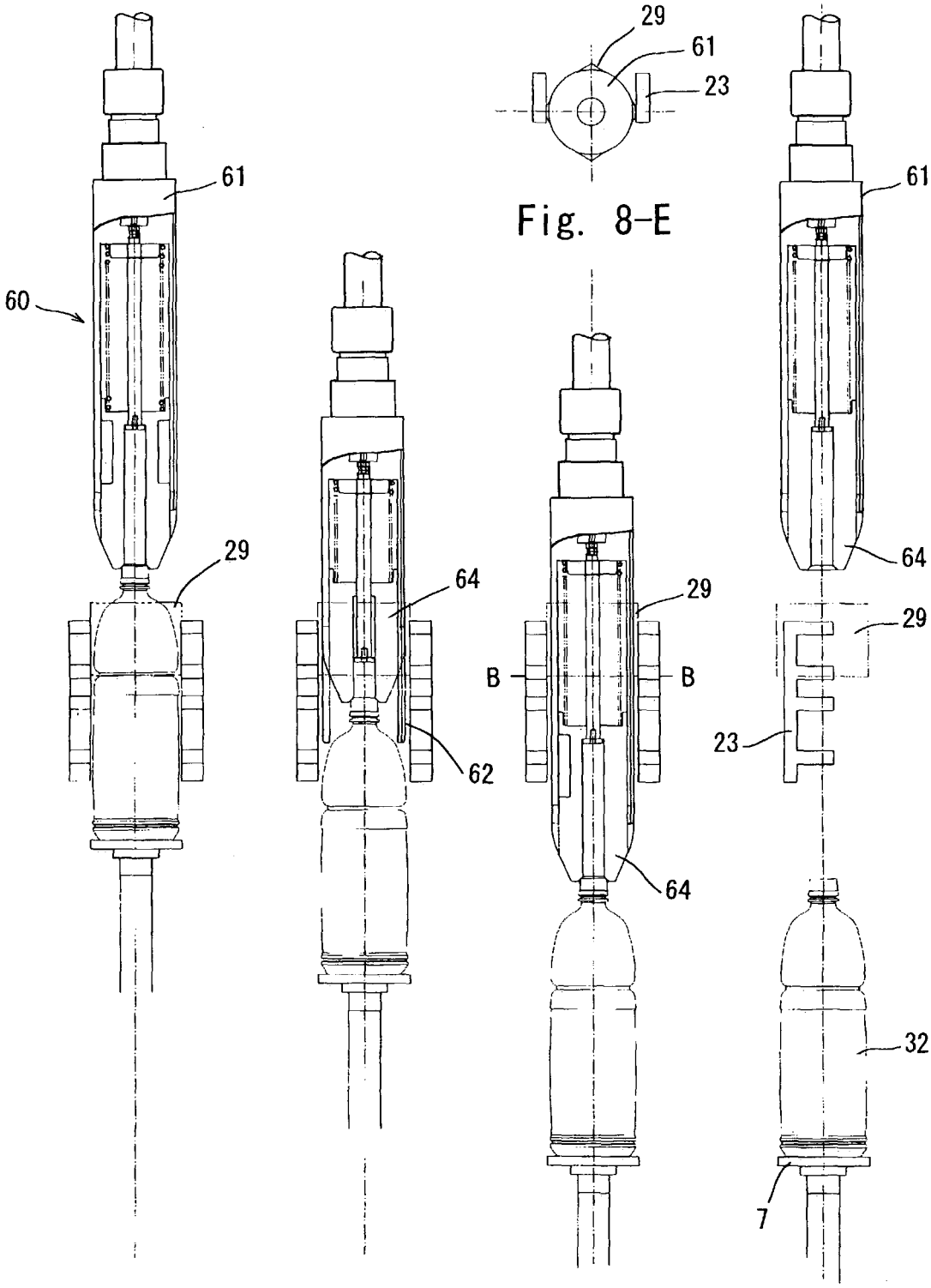
Fig. 8-D Fig. 8-C Fig. 8-B Fig. 8-A

Prior Art

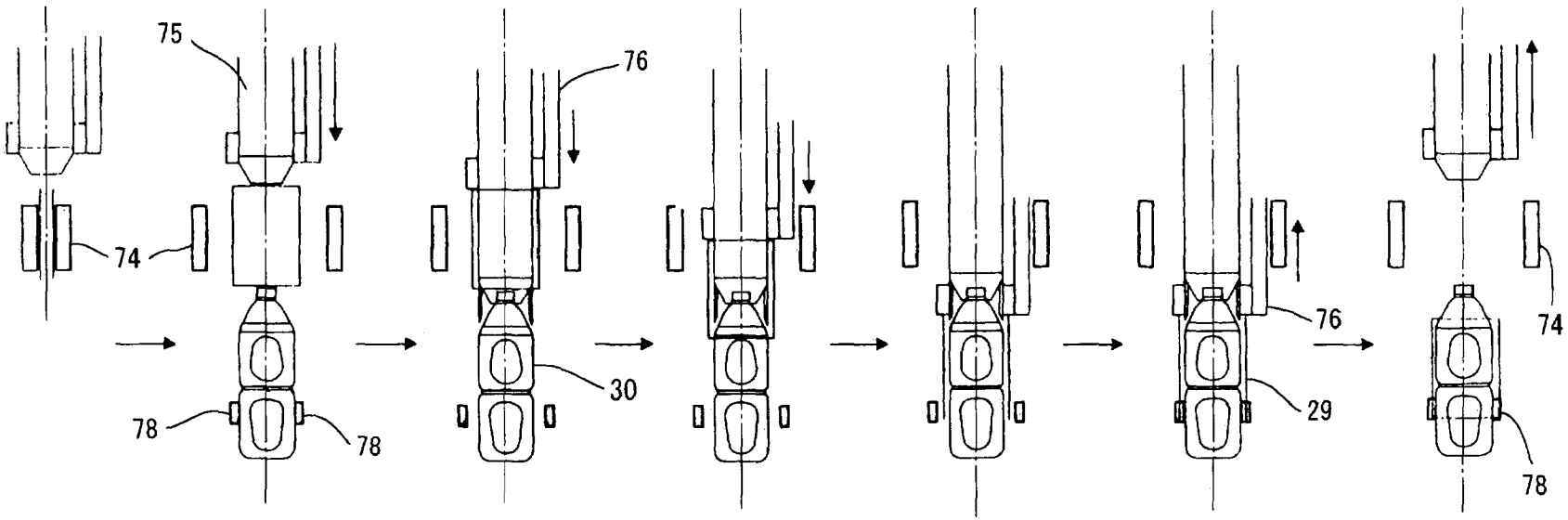
Fig. 10-A Fig. 10-B Fig. 10-C Fig. 10-D Fig. 10-E Fig. 10-F
Prior Art Fig. 11-A
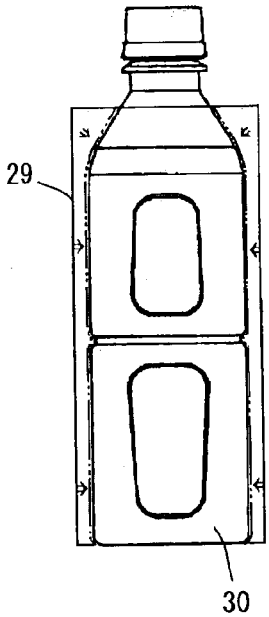
Fig. 11-B
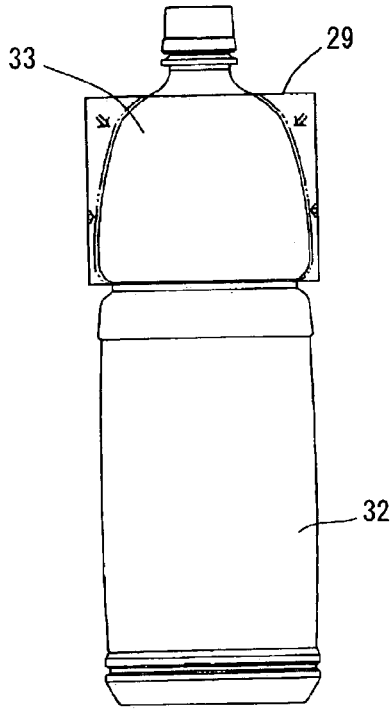
Fig. 11-C
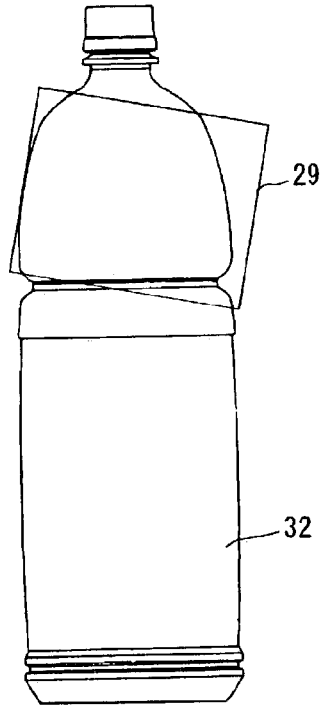

TUBULAR LABEL FITTING APPARATUS FOR CONTAINERS

BACKGROUND OF THE INVENTION

1. Field of the Invention

The present invention relates to a tubular label fitting apparatus that automatically fits a tubular label to a container such as a bottle.

2. Description of the Related Art

In the conventional and widely used application, a tubular label (referred to as simply "label" hereinafter) with heat shrinking properties is fitted to a container (referred to as simply "bottle" hereinafter) such as a synthetic resin bottle or glass bottle, and is then shrunk in order to mount a label to the bottle. Examples of a conventional label fitting apparatus are shown in Japanese Patent Application Laid-open No. 2000-289715, Japanese Patent Application Laid-open No. 2000-264319, and Japanese Patent Application Laid-open No. 2002-87417. The basic aspect of a conventional label fitting apparatus is shown in FIGS. 9 and 10, and comprises an infeed wheel 70, a main turret 71, a rotary vacuum transfer finger 72 and a discharge wheel 73, and as shown in FIG. 10 each head of the main turret comprises a bottle holder 78 that may open and close, a vacuum jaw 74 that holds a label by suction, a mandrel (pilot) 75 that moves vertically, and a label pusher 76 that presses a label down to a specified position on a bottle.

In the above apparatus, a label is mounted by the process shown in FIG. 10 in which a bottle supplied by an infeed wheel 70 is held by a bottle holder 78, and is conveyed in a circular motion along a guide mechanism 77 that is positioned on the outer fixed portion of the main turret. That is to say, a bottle holder 78 holds a bottle 30 and the main turret 71 rotates, thus reaching the label opening end position and the mandrel 75 begins to lower (process a), such that when the mandrel tip engages with the cap of the bottle 30 and determines the positioning, the bottle holder 74 opens. In this condition, the label pusher 76 lowers and presses down on the label to fit the label onto the bottle (process c), and the bottle holder re-closes when the label insertion is complete (processes d and e). When the bottle holder has completely closed (process e), the mandrel 75 and the label pusher 76 rise and return to the home position (process f). Upon reaching the position of the discharge wheel, the bottle holder opens and the bottle is transferred to the pocket of the discharge start wheel, and is conveyed to a shrink apparatus by a discharge conveyer, and the label 29 is heated so that the label 29 is shrunk and adheres to the outer face of the bottle.

As described above, the main turret in the conventional apparatus requires a bottle holder to grasp the bottle body and a fixed guide that is positioned on the outer fixed portion of the bottle conveyance path, such that a line change must be performed by changing the bottle holder and fixed guide according to the bottle size and differences in the bottle shape such as a round cross-sectional shape or square cross-sectional shape, which has the drawback of requiring considerable man-hours and labor to implement line changes each time a different bottle type is used. In addition, the conventional apparatus using the label holding means requires a label pusher to push down on the label held by the label holding means, in order to fit the label to the bottle in a stable manner. Furthermore, to ensure that the label fitting apparatus mounts the label on the bottle in the correct direction and correct position, caution is required to prevent misalignment of the label from when the label has been fitted until the bottle reaches the shrink oven, but the conventional apparatus has the drawback of easily resulting in misalignment of the label, in that the bottle that is fitted with a label is grasped from above, which causes the label to move when the bottle is grasped and when the holder opens.

On the other hand, when fitting a label 29 to a relatively small bottle 30 such as the 500 ml capacity bottle shown in FIG. 11-A, the label in most cases covers the entire body, whereas in the case of a 1-liter or 2-liter large capacity bottle 32 of the type shown in FIG. 11-B, the label frequently covers only the shoulder of the bottle 33. In this case, the label 29 becomes unstable and easily tilts to the side, such that when the label is not correctly engaged as shown in FIG. 11-C, the label is fitted while tilted to the side, and when the label is shrunk under the same condition the label becomes wrinkled as it shrinks, which has the drawback of resulting in a defective product, thus pointing to the need for a more accurate apparatus for fitting a label to a bottle.

SUMMARY OF THE INVENTION

With the foregoing in view, it is an object of the present invention to provide a label fitting apparatus that eliminates the need for the bottle holder and fixed guide required in the conventional apparatus, that shortens the man-hours needed to implement line changes or enables instantaneous line changes, that simplifies the construction of the apparatus by eliminating the need for a fitting label pusher, and is further capable of accurately mounting a label solely to an unstable location such as the shoulder of a bottle without causing misalignment of the label.

The label fitting apparatus of the present invention that resolves the above-mentioned drawbacks is a tubular label fitting apparatus for containers which has a plurality sets of label fitting heads arranged at even intervals on the outer perimeter of a main turret, wherein each label fitting head comprises a container table, a container presser bar means that applies a pressing force against the top of a container supported by the container table, and a label holding means; and wherein the rotation of the main turret causes the container presser bar means to lower and pass through a label held by the label holding means, and to apply a pressing force against a container supplied by the container table such that the container is sandwiched between the container table and the container presser bar means, and in this condition the container is transferred in an axial direction relative to the label holding means such that the label is fitted on the container.

The relative movement in the axial direction of the container and the label holding means may be achieved either by holding the label at a fixed position and vertically moving the container table and the container presser bar means, or by holding the container at a fixed height position and vertically moving the label presser bar means, or by moving both the container and label presser bar means in an axial direction. In addition, the above-mentioned container presser bar means is constituted by a container presser bar body, and a label attitude control element which is provided on the lower part of the container presser bar body and has an outer diameter that is larger than the diameter of the container presser bar unit and smaller than the diameter of the fitting label, such that the label may be fitted in a stable and accurate manner even when the label is mounted to a position such as the shoulder of a bottle. The above-mentioned label attitude control element is comprised of an attitude control element that engages the label, and a container pressing head that abuts against the top of a container, and it is preferable that the container pressing head has a cushioning capability against the attitude control element unit. Furthermore, the above-mentioned attitude control element unit comprises at the bottom edge thereof a plurality of splined grooves divided in a circumferential direction, whereas the above-mentioned container pressing head comprises a plurality of ridges on the outer circumference thereof that engage with the splined grooves of the above-mentioned attitude control element unit, and further comprises a container abutting section on the lower edge thereof. Thus a taper is formed from the above-mentioned protrusions to the container abutting section, enabling a label to be accurately fitted to a container.

BRIEF DESCRIPTION OF THE DRAWINGS

FIGS. 4-A and 4-B are illustrative schematic diagrams respectively showing the action of the vacuum jaw in the condition in which the bottle rises and is fitted with a label which is supported and grasped by the vacuum jaw, and in the condition in which the vacuum jaw presses the label against and causes the same to adhere to the bottle and subsequently is released therefrom;

FIG. 6-A to FIG. 6-D are an illustration showing the process for fitting a label with the bottle presser bar means shown in FIG. 5;

FIGS. 7*a*, 7*b* and 7*c* are cross-sectional diagrams showing the principal part of the bottle presser bar means according to a further embodiment of the label fitting apparatus that is the present invention, FIG. 7-A showing the normal condition, FIG. 7-B the condition of the bottle applying a pressing force against the container pressing head, and FIG. 7-C being the cross-sectional view taken along line A—A in FIG. 7-A;

FIG. 8-A to FIG. 8-D are an illustration showing the process for fitting a label with the bottle presser bar means shown in FIG. 7, FIG. 8-E is the cross-sectional view taken along line B—B in FIG. 8-B;

FIG. 10-A to FIG. 10-F are a development drawing showing the label fitting process using a conventional label fitting apparatus;

FIGS. 11-A, 11-B and 11-C are elevation views showing the conditions of a label fitted to a bottle.

DESCRIPTION OF THE PREFERRED EMBODIMENTS

The following description details an embodiment of the present invention.

Figure 1:
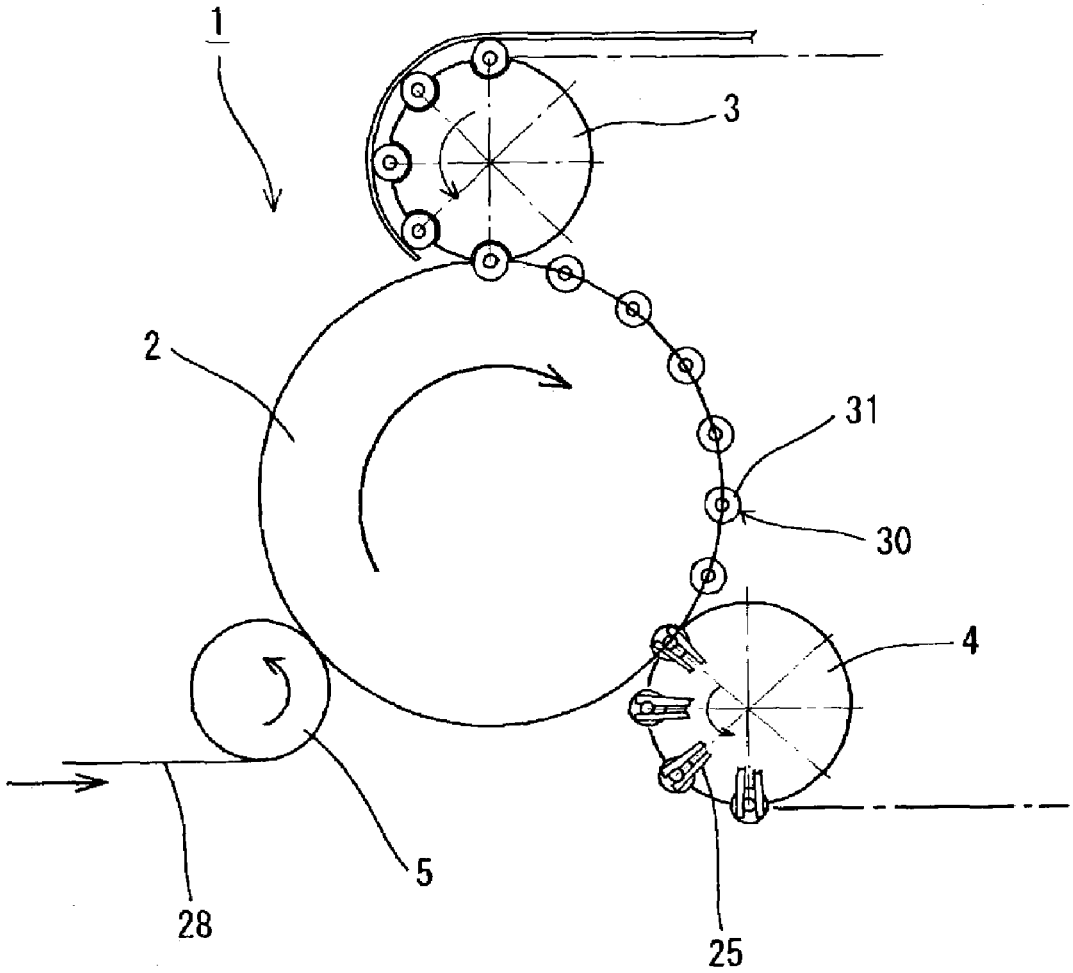
FIG. 1 is a plan schematic diagram of the label fitting apparatus according to an embodiment of the present invention.
Figure 2:
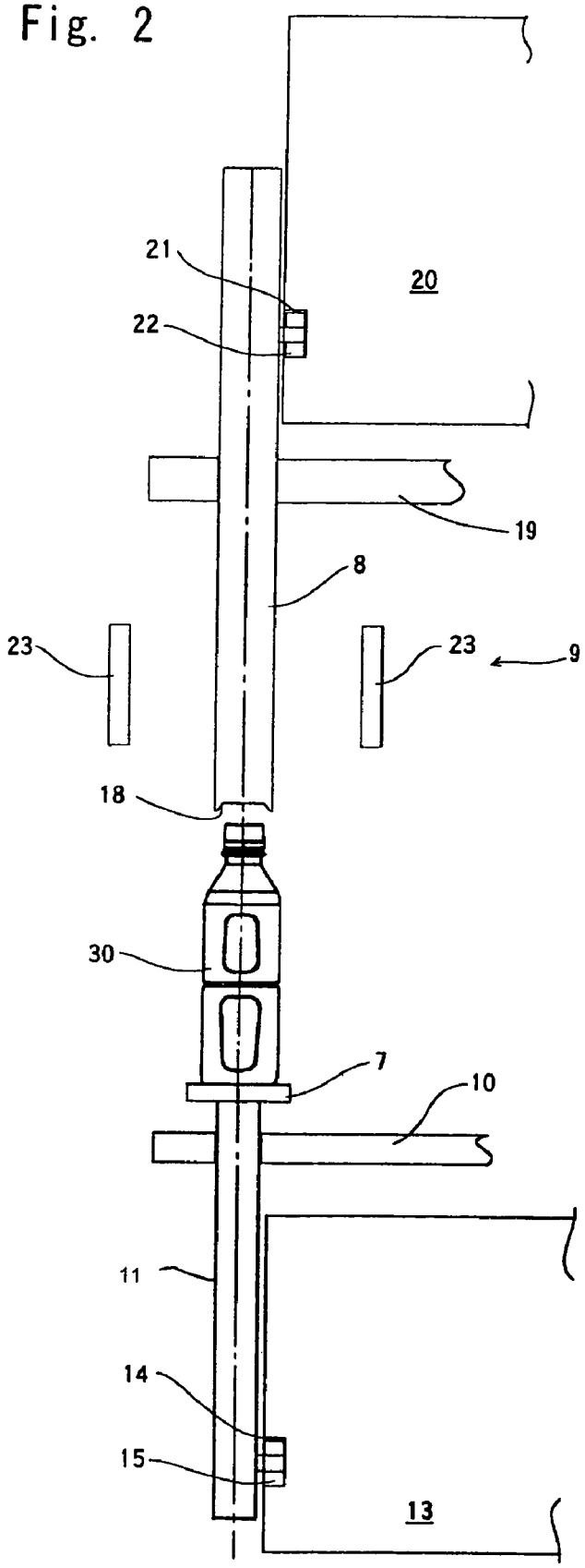
FIG. 2 is a schematic diagram showing the principal part of the configuration of the label fitting head.
Figure 3:
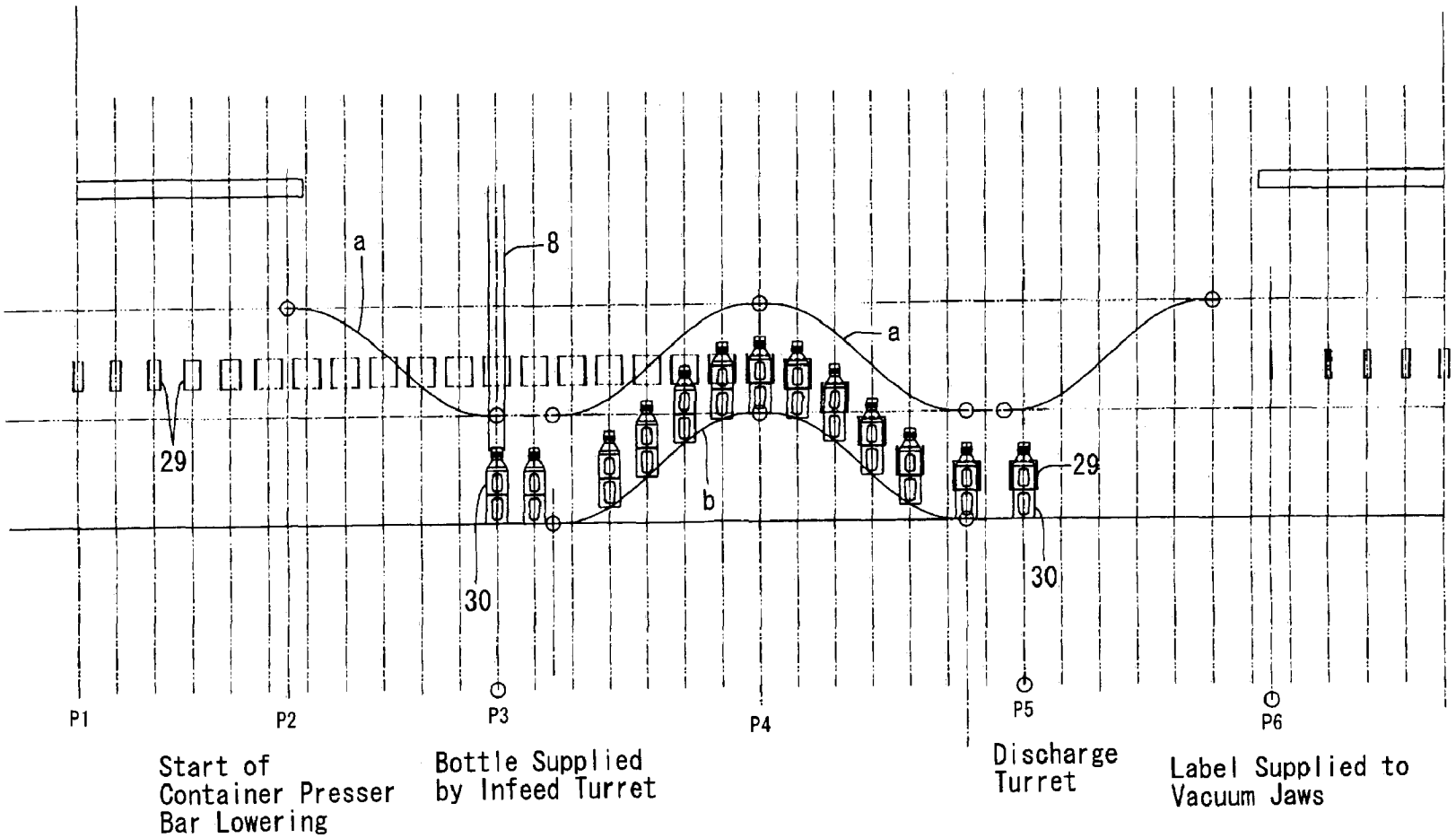
FIG. 3 is a development drawing showing the fitting process for the label fitting apparatus according to an embodiment of the present invention.

FIG. 1 shows a plan schematic diagram indicating the basic aspect of a label fitting apparatus that is the present invention, FIG. 2 shows the basic composition of a label fitting head thereof, and FIG. 3 is a development drawing showing the fitting process with the label fitting apparatus. The label fitting apparatus 1 according to this embodiment is designed for fitting a label consisting of a shrinkable synthetic resin film that comprises a label to a container such as a bottle, and is comprised of a main turret 2, an infeed turret 3 that is placed on the outer circumference of the main turret 2, a discharge turret 4 that transfers the bottles from the main turret 2 to a conveyer after the bottles have been fitted with a label, and a rotary vacuum transfer finger apparatus 5 that supplies the labels. In the above-mentioned configuration, the present invention notably differs from the conventional art in terms of the configuration of the main turret 2, which is described in detail below.

The main turret 2 of this embodiment comprises a plurality of sets of label fitting heads positioned at even intervals and each comprising a container table 7 that supports the bottom of a bottle 30, a container presser bar means 8 that applies a pressing force against the cap of a bottle supported by the container table 7, and a label holding means 9 that expands and holds the label by suction, and is designed such that when a container is supplied by the infeed turret to the container table 7, the bottle is simultaneously supported by sandwiching the bottle between the container table 7 and the container presser bar means 8, and the bottle is rotated and conveyed. As a result, the bottle may be rotated and conveyed in a stable manner without the conventional use of a bottle holder and fixed guide, thereby eliminating the labor involved in line changes and also simplifying the construction of the apparatus.

The container table 7 is provided at the top of a rod 11 that is supported on the bottom turret board 10 in a vertically movable manner, and the bottom of the rod comprises a cam follower 15 that engages with the cam grooves 14 of a bottom fixed cylindrical cam 13 that is positioned on the circumference of the rotational path of the turret, such that the rotation of the turret causes the rod 11 to move vertically within a specified range along the cam groove, as shown in the FIG. 3 development drawing. In this embodiment, the bottle 30 is raised until the label mounting position for the bottle reaches a label held by a label holding means, such that the bottle directly receives the label from the label holding means. Consequently, a label may be reliably fitted without requiring the fitting label pusher that is needed by the conventional apparatus, such that the construction may be simplified.

The container presser bar means 8 and the above-mentioned container table 7 jointly support and sandwich the bottle. The design of the container presser bar means 8 may be selected arbitrarily so long as the bottom surface thereof can press the top surface of the cap mounted to a bottle, and the container presser bar means 8 may be comprised of a pressure bar body consisting of a round bar with a simple flat top surface. However, it is preferable to provide a tapered face 18 on the bottom end of the presser bar body so that this tapered face 18 consistently touches the outer circumference of the top surface of the cap and to support the cap at the center thereof as shown in FIG. 2, irrespective of changes in the outer diameter of the cap as a result of a line change. The container presser bar means 8 is positioned such that the container presser bar means 8 may move in a vertical direction symmetrically along the same axis as the rod 11, and is supported such that it may move in a vertical direction and passes through the top turret board 19, and comprises a cam follower 22 at the top of the container presser bar means 8 that engages with the cam groove 21 of the top fixed cylindrical cam 20 which is positioned along the rotating path of the turret, such that the rotation of the main turret 2 causes the container presser bar means 8 to move in a vertical direction within a specified range along the cam groove 21, as shown in the FIG. 3 development drawing. The lower end face of the container presser bar means 8 is at a higher position than the label holding means 9 when at the home position, and when a bottle is transferred from the infeed turret 3 to the container table 7 the container presser bar means 8 simultaneously lowers in order to apply a pressing force against the top surface of the bottle cap. Once the bottle is supported, the stroke of the vertical movement of the container presser bar means 8 is controlled by the cam groove 21 so as to be synchronized with the container table 7. Furthermore, the bottommost edge lowering position of the container presser bar means 8 must change according to the bottle height. In this embodiment the top fixed cylindrical cam 20 is configured such that the height position may be adjusted according to the bottle type, and may be automatically adjusted with the single press of a button corresponding to the bottle type used at the time of the line change.

The label holding means 9 comprises a pair of opposing vacuum jaws 23 that hold by suction both walls of a label 29 that is imparted a flattened shape as shown in FIG. 4, and is designed so as to be capable of opening and closing using a suitable opening and closing means not shown in the drawing. The pair of vacuum jaws 23 hold the label 29 received from the rotary vacuum transfer finger apparatus 5 by suction, and concurrent to the rotation of the main turret, and the label 29 is gradually expanded along with the rotation of the main turret, as shown in FIG. 3. Next, the container presser bar means 8 lowers and passes through the inside of the expanded label to hold and sandwich the bottle, and in this condition the bottle rises and is thereby engaged with the label 29.

The infeed turret 3, discharge turret 4 and rotary vacuum transfer finger apparatus 5 may employ a publicly known means, but in this invention the container presser bar means lowers at the same time that a bottle is received from the infeed turret 3. Therefore, the label holding means must have held the label by this time, and thus the rotary vacuum transfer finger apparatus 5 is placed upstream from the infeed turret. The discharge turret may employee a star wheel similarly to a publicly known art, but in this embodiment, it is avoided to grasp the label when receiving a bottle, so as to prevent misalignment of the label fitted on the bottle, and the discharge turret is provided with evenly spaced neck holders 25 that grasp the neck 31 of a bottle 30.

The following description details the operation of the label fitting apparatus of the present embodiment, based on the FIG. 3 development drawing.

In the FIG. 3 development drawing, the curve a represents the stroke curve of the container presser bar means, and the curve b represents the stroke curve of the container table.

A web-shaped label 28 is supplied in a continuous web shape and cut by the rotary vacuum transfer finger apparatus 5 into an label 29 having a predetermined dimension, and is supplied to the label holding means 9 of the main turret 2 at the label supply position P1. As the main turret rotates, the label 30 is gradually expanded by a suitable cam mechanism or the like, and when the label 30 has almost completely expanded at position P2, the container presser bar means 8 begins to lower and continues to lower and pass through the inside of the expanded label, until the bottle feed position P3 is reached. On the other hand, the infeed turret 3 supplies the bottle 30, which has previously been filled with the container contents and sealed, to the container table 7 of the main turret, at the bottle feed position P3. At that point, the container presser bar means 8 lowers and applies a pressing force against the bottle cap and supports the bottle by sandwiching the bottle between the container presser bar means 8 and the container table 7. Consequently, the bottle is fixed in place and rotates in unison with the main turret without requiring a bottle holder to hold the bottle body or a guide, and does not cause misalignment of the label.

Under the condition in which the bottle 30 is sandwiched between the container table and the container presser bar means, the cam action that accompanies the rotation of the main turret raises the bottle, as shown in FIG. 3, and when the bottle reaches the bottle label mounting position P4, the bottle is kept stationary for only a specified time as shown in FIG. 3, during which time the vacuum jaws 23 of the label holding means 4 as shown in FIG. 4*b* momentarily close slightly such that the label 29 held by the vacuum jaws 23 is lightly pressed against the bottle 30 at the mounting position, and at the same time the vacuum suction is released to enable the label 29 to stick to the bottle body. The label fitting position of the bottle body has been sprayed with tap water or a cleaning solution using a spray nozzle not shown in the drawings just prior to supplying the bottle to the main turret, such that the label fitting position is in a wet condition, and the label that is formed by a shrinkable film sticks to the bottle by just slightly pressing the label against the bottle. Subsequently, the bottle having the label stuck at the specified position is lowered under the condition in which the bottle is sandwiched between the container table and container presser bar means, until the bottle reaches the receiving position P5 where the bottle is transferred to the discharge turret 4. During this time, it is preferable that the vacuum jaws are maintained in a further widened condition so as not to obstruct the tube fitted on the bottle as it passes through the vacuum jaws. On the other hand, the container presser bar means 8 begins to rise and returns to the home position at position P6. Note that, in the above-mentioned embodiment, the vacuum suction is released at the same time that the vacuum jaws 23 momentarily close slightly in order to slightly press the label 29 against the mounting position of the bottle 30, however, it is not necessary for the vacuum jaws to momentarily close, since simply releasing the vacuum suction allows the expanded label to return to its original flattened condition due to the elasticity of the label, thus enabling the label to adhere to the bottle.

When the discharge turret 4 receives a bottle from the main turret 2, the neck holder 25 holds the neck of the bottle and the discharge turret 4 transfers the bottle to the conveyor leading to the next process, which is the shrinking process. Consequently, the bottle may be transferred without directly touching the label, and the label is not touched by a holder or the like while the bottle is conveyed after being fitted with the label, such that misalignment of the label is not caused and the bottle is transferred to the shrinking process in this condition, where the label is heated and adheres to the specified position of the bottle by heat contraction. Therefore, the label fitting apparatus of this embodiment enables the letters and patterns on the label to be accurately mounted to the specified position of a bottle, and enables the obtainment of a high quality product.

Figure 5:
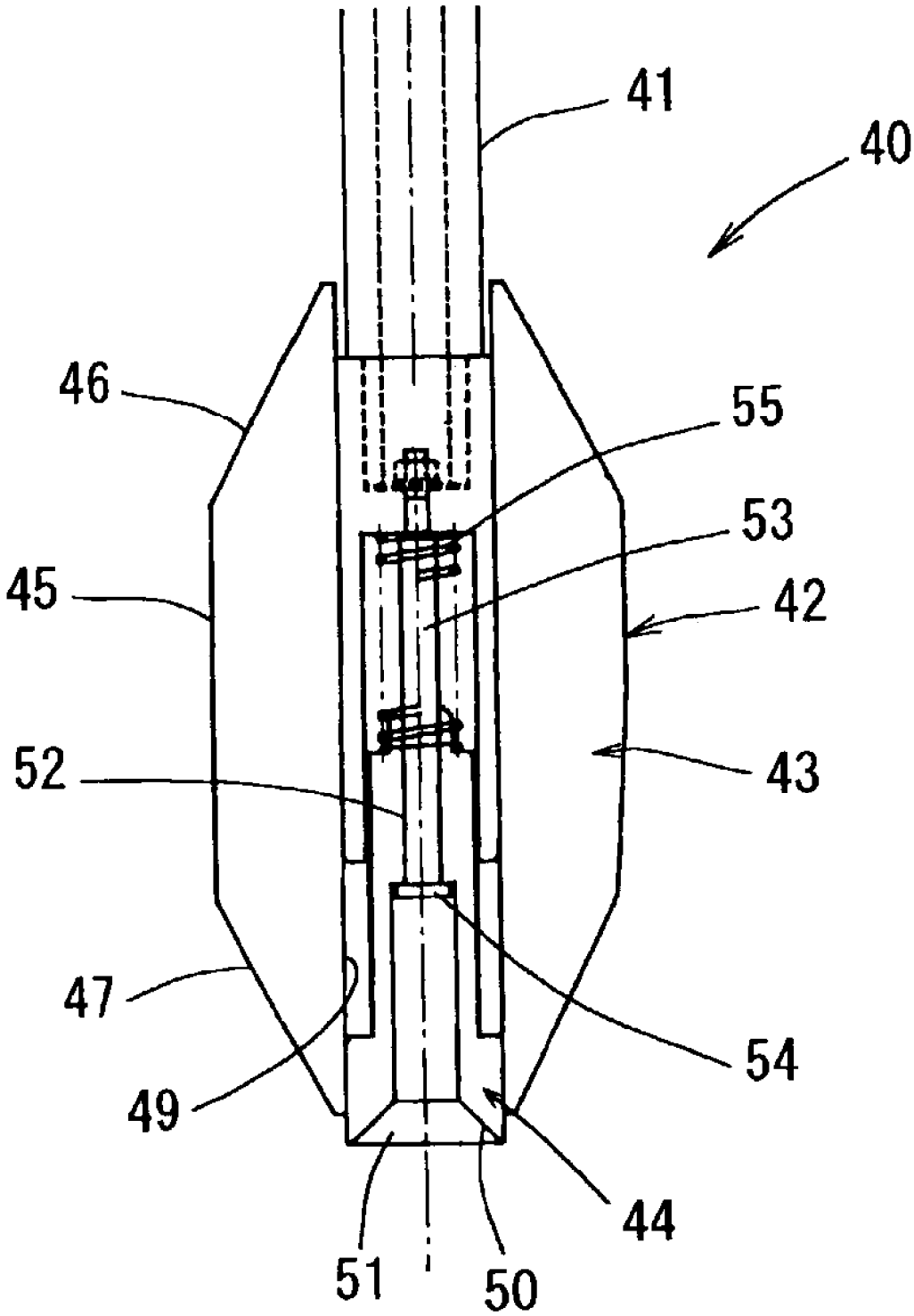
FIG. 5 is a cross-sectional diagram showing the principal part of the bottle presser bar means according to another embodiment of the label fitting apparatus that is the present invention.
Figure 9:
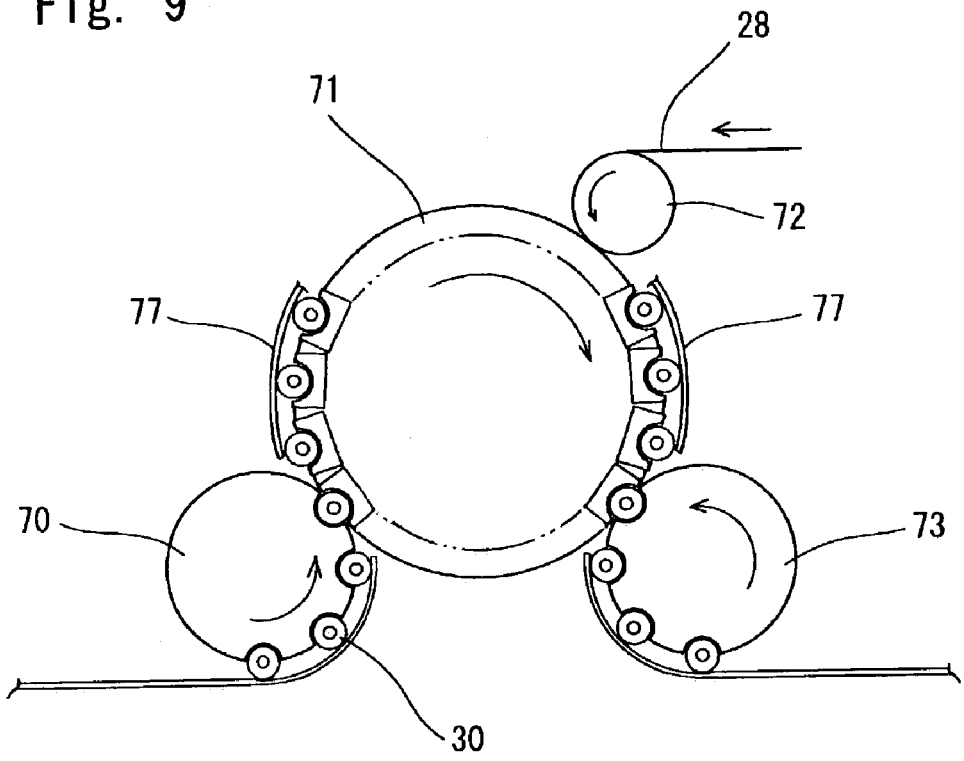
FIG. 9 is a plan schematic diagram showing a conventional label fitting apparatus.

FIG. 5 shows another embodiment of the label fitting apparatus that is the present invention, and in this embodiment the label may be fitted to a container with greater perpendicularity, and the label may be accurately mounted to a container without being tilted to one side, even when the label is mounted solely to the sloped shoulder of a bottle.

This label fitting apparatus is different from the above-mentioned embodiment particularly in terms of the configuration of the container presser bar means. In this embodiment, the container presser bar means 40 comprises a presser bar body 41, and a label attitude control element 42 that is removably provided at the bottom of the presser bar body. The label attitude control element 42 comprises an attitude control element body 43 that engages with the label held by the vacuum jaws to maintain the attitude of the tube, and a container pressing head 44 which is held at the center of the bottom edge of the attitude control element body 43 such that the container pressing head 44 has a cushioning capability in the axial direction. The attitude control element body 43 comprises a middle cylinder portion 45 having an outer diameter that is larger than the diameter of the presser bar body 41 and slightly smaller than the diameter of the fitting tube, and further comprises an upper tapered surface 46 and a lower tapered surface 47 on the top and bottom edges respectively. By possessing this type of lower tapered surface 47, engagement of the attitude control element unit 43 is more easily accomplished when the attitude control element unit 43 lowers from a position above the label which is held by the vacuum jaws, and by possessing the upper tapered surface 46, engagement of the attitude control element body 43 is more easily accomplished when the attitude control element body 43 rises from a position below the label under the condition in which the attitude control element body 43 holds a bottle by sandwiching the same between the attitude control element body 43 and the container table 7. By further comprising a middle cylinder portion 45, the label may be engaged with the bottle while maintaining the perpendicularity of the label. Consequently, it is preferable that the length of the middle cylinder portion 45 should be equal to or greater than the height of the label. Further, if the attitude control element unit 43 is formed long enough such that the top edge of the attitude control element body 43 does not protrude from the label at its lowermost position, the attitude control element unit is not necessarily formed with an upper tapered surface.

As shown in FIG. 5 in an enlarged scale, the container pressing head 44 is slidably fitted in the slide hole 49 formed in the axial center of the attitude control element unit 43, and the bottom edge of the container pressing head 44 comprises a hole 51 that further comprises a conical surface 50 that serves as a container abutting section abutting against the outer perimeter edge at the top of the cap, and at the top of this hole is formed a guide rod fitting hole 52 in which the guide rod 53 is fitted. The head 54 of the guide rod 53 engages with the bottom edge outer perimeter surface of the hole 52, thus limiting the lowering of the container pressing head 44. The upper part of the guide rod fitting hole 52 is fixed to the attitude control element body, and a spring 55 is provided between the attitude control element body 43 and the container pressing head 44 to constantly urge the container pressing head 44 downwards.

The following description is based on the process chart shown in FIG. 6, and describes the fitting operation of the label pusher to the bottle in this embodiment, which comprises the presser bar means configured as described above.

As in the above-mentioned embodiment, the container presser bar means 40 lowers from the state in which the vacuum jaws 23 hold the label open by means of suction as shown in FIG. 6-A, until the label attitude control element 42 passes through the label and the bottom surface of the container pressing head 44 engages with the cap 33 of the bottle 32, to support the bottle 32 by sandwiching the same between the container table 7 and the container pressing head 44, as shown in FIG. 6-B. At that point, the lower tapered surface 47 formed on the label attitude control element 42 enables the label attitude control element 42 to smoothly engage with the label, even when the outer diameter of the middle cylinder portion 45 is close to the inner diameter of the label 29, thus avoiding any tilting of or damage to the label.

The container table and the container presser bar means rise in synchronization under this condition, whereby the label attitude control element 42 re-engages with the label from the bottom side, and the label is thereby shaped in the condition shown in FIG. 6-C in which the label is expanded correctly to the container cross-sectional shape. At that point, the upper tapered surface 46 formed on the label attitude control element 42 enables the label attitude control element 42 to smoothly engage with the label 29. The container table 7 and the container presser bar means 40 further rise in synchronization from this condition, until the shoulder of the bottle which represents the position to which the label is stuck reaches the position of the label as shown in FIG. 6-D, under which condition the vacuum jaws release the suction. As a result, the label which has been held by the vacuum jaws shrinks due to the elasticity and is attached to the shoulder of the bottle by the moisture adhering to the shoulder of the bottle, The label is thus fitted to the specified position of the bottle. Subsequently, the same shrinking method used in the above-mentioned embodiment causes the label to be fitted to the bottle. In this way, the container presser bar means 40 in this embodiment comprises a label attitude control element 42 that enables the label to be maintained at the correct attitude until just prior to fitting the label to the bottle, such that the label may be accurately fitted without tilting, even when the label is mounted solely to the shoulder of a container. Furthermore, when mounting labels to a different size of container, the label attitude control element may simply be changed to an appropriately sized label attitude control element in order to easily accomplish a line change.

FIG. 7 shows a further embodiment of the label fitting apparatus that is the present invention, and in this embodiment the container presser bar means and particularly the label attitude control element are further modified. The elements in FIG. 7 that are the same as the embodiment shown in FIGS. 5 and 6 are assigned the same numbers, and the following description details only the different points from the embodiment shown in FIGS. 5 and 6.

In a container presser bar means 60 of this embodiment, the attitude control element unit 62 of a label attitude control element 61 is formed in a hollow cylinder shape, and on the outer perimeter surface of the attitude control element unit 62 are formed splined grooves 63 that engage with the protruding splines 67 of the container pressing head 64. As a result, the outer perimeter surface of the label attitude control element 61 and the outer perimeter surface of the protruding splines 67 of the container pressing head 64 are positioned at the circumference surface with the same diameter, and engage with the label with a slight gap. The container pressing head 64 comprises a lower tapered surface 65 that functions as a guide surface so that the label attitude control element 61 engages with the label, and on the lower edge surface of the container pressing head 64 is formed a container abutting section 66 which engages with the cap of a bottle. When a pressing force is applied by a bottle, the spring 55 provides a means of cushioning, and the container pressing head 64 recedes inside the attitude control element unit 62 as shown in FIGS. 7-B and 8-C, but the bottom edge of the outer perimeter surface of the attitude control element unit 62 continues to be positioned near the bottle shoulder, under which condition the bottom edge of the label may accurately engage while maintaining a round shape. In other words, in this embodiment a tapered surface is formed on the container pressing head to function as a guide for engaging the label, and the attitude control element unit is formed with only the cylindrical surface required to maintain label in the cylindrical condition, and the tapered surface and the attitude control element body are separately formed to enable independent movement of the tapered surface in relation to the attitude control element body. Therefore, only the container pressing head 64 can be cushioned while the bottom edge of the attitude control element unit 62 is maintained at a position near the bottle shoulder, as shown in FIG. 7-B. Note that, in this embodiment, the application to a bottle with a cylindrical cross-sectional shape is described, but the present invention may also be applied to a bottle with a square cross-sectional shape.

The above description of the embodiment of the present invention is not limited to the above-mentioned embodiments, and various design changes are possible within a range of technical ideas. For example, it is also possible to configure the apparatus in the reverse manner of the above-mentioned embodiment, such that a container is maintained at a specified height, and the label holding means is lowered to enable the label to fit on the container. Furthermore, the supply and ejection of containers to and from the main turret is not limited to an infeed turret and discharge turret, and is capable of employing another transfer means.

As described above, the present invention eliminates the need for the bottle holder and the fixed guide required by the conventional apparatus, and further eliminates the labor required to change the bottle holder and fixed guide to implement line changes, and dramatically reduces the number of man-hours required to implement line changes when compared with the conventional apparatus, and enables improved production efficiency. Furthermore, the present invention is capable of fitting a label from vacuum jaws to a container without using a fitting label pusher as is conventionally required, and simplifies the construction as well as reduces the number of elements touching the label, thus enabling less frequent misalignment of the label. Furthermore, according to the configuration in claim 4, since the label is not directly supported and grasped while being conveyed by the discharge turret, the label can be transferred from the main turret to the discharge turret without causing misalignment, and can be accurately mounted to the container, and therefore the label mounting quality can be improved.

What is claimed is:

1. A tubular label fitting apparatus for containers which has a plurality sets of label fitting heads arranged at even intervals on the outer perimeter of a main turret, wherein each label fitting head comprises a container table, a container presser bar means that applies a pressing force against a top of a container supported by said container table, and a label holding means; and wherein rotation of said main turret causes said container presser bar means to lower and pass through a tubular label held by the label holding means, and to apply a pressing force against a container supplied by the container table such that the container is sandwiched between the container table and the container presser bar means, and in this condition said container is transferred in an axial direction relative to the label holding means such that the label is fitted on the container.

2. The tubular label fitting apparatus according to claim 1, wherein a label held by the label holding means is fitted on the container by moving vertically the container table and the container presser bar means in a synchronized manner under a condition in which a bottle is sandwiched between the container table and the container presser bar means.

3. The tubular label fitting apparatus according to claim 1, wherein a label is fitted on a container sandwiched between the container table and the container presser bar means by moving the label holding means vertically.

4. The tubular label fitting apparatus according to claim 1, wherein said container presser bar means comprises a container presser bar body, and a label attitude control element that is provided on a bottom portion of said container presser bar body and has an outer diameter that is larger than the diameter of said container presser bar body and smaller than a diameter of a fitting label.

5. The tubular label fitting apparatus according to claim 4, wherein said label attitude control element comprises an attitude control element body that engages with a label and a container pressing head that abuts against the top of the container, and the container pressing head is designed to be capable of cushioning in relation to the attitude control element body.

6. The tubular label fitting apparatus according to claim 4, wherein said attitude control element body comprises a plurality of splined grooves formed at a bottom portion thereof and separated in a circumferential direction, and said container pressing head comprises on an outer perimeter thereof a plurality of protruding splines that engage with the splined grooves of the attitude control element body, and further comprises a container abutting section on the lower edge thereof; and wherein a lower portion of said container pressing head is tapered, the narrowest end of the taper formed at the container abutting section.

7. A label fitting apparatus for fitting a label on a container, comprising:

a main turret including a label fitting head, the label fitting head comprising, a container table to support the container;

a container presser bar to apply a pressing force against a top of the container supported by the container table; and a label holder to hold the label, wherein the main turret is operably connected to the container presser bar and the container table such that rotation of the main turret causes the container presser bar to lower and pass through a label held by the label holder to apply a pressing force against a container supported by the container table, and causes the container table and label holder to move in an axial direction relative to each other such that the label is fitted on the container.

* * * * *